United States Patent [19]

Shinozaki

[11] 4,114,775

[45] Sep. 19, 1978

[54] CAP WITH SEALING LINER

[75] Inventor: Tokujiro Shinozaki, Nagoya, Japan

[73] Assignee: Japan Crown Cork Co., Ltd., Tokyo, Japan

[21] Appl. No.: 774,143

[22] Filed: Mar. 3, 1977

[30] Foreign Application Priority Data

Mar. 11, 1976 [JP] Japan ..... 51-25538
Nov. 18, 1976 [JP] Japan ..... 51-137773

[51] Int. Cl.[2] ..... B65D 53/00
[52] U.S. Cl. ..... 215/324; 215/343
[58] Field of Search ..... 215/324, 325, 327, 341, 215/343, 345, 354, DIG. 1

[56] References Cited

U.S. PATENT DOCUMENTS

| | | | |
|---|---|---|---|
| 2,326,809 | 8/1943 | White | 215/345 X |
| 2,543,775 | 3/1951 | Gora | 215/327 |
| 3,360,148 | 12/1967 | Owen | 215/345 |
| 3,788,508 | 1/1974 | Vercillo | 215/343 |
| 3,828,963 | 8/1974 | Moller | 215/341 X |
| 3,883,025 | 5/1975 | Jemmett | 215/341 |

*Primary Examiner*—Donald F. Norton
*Attorney, Agent, or Firm*—Wenderoth, Lind & Ponack

[57] ABSTRACT

A cap includes a metallic cap shell having a circular top and a skirt extending downwardly from the peripheral edge of the top and provided with a thread-forming portion deformable along the thread of the opening part of a container, and a flexible liner provided inwardly of the top of the cap shell. The liner includes an annular protrusion having an inside diameter substantially equal to, or slightly larger than, the outside diameter of the sealing surface of the opening of a container to be sealed and comprising a perpendicular inside wall adapted to seal intimately with the peripheral sealing surface of the container opening and an upright outside wall spaced apart from the inner circumferential surface of the skirt.

9 Claims, 11 Drawing Figures

Fig. 9A
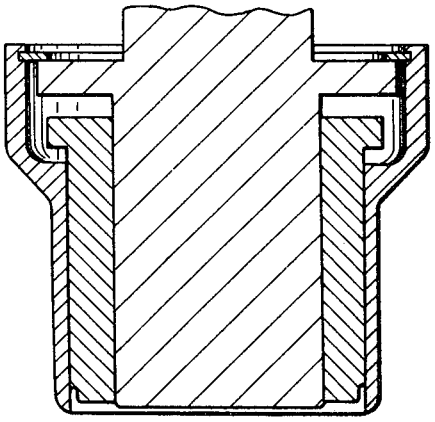
Fig. 9B
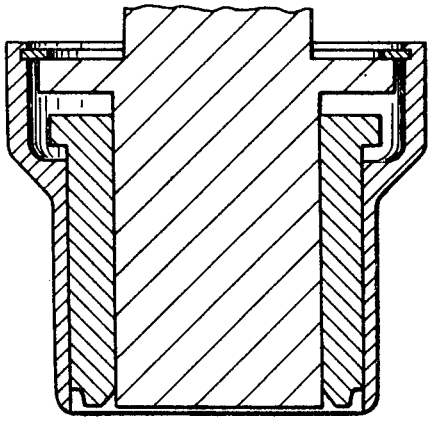
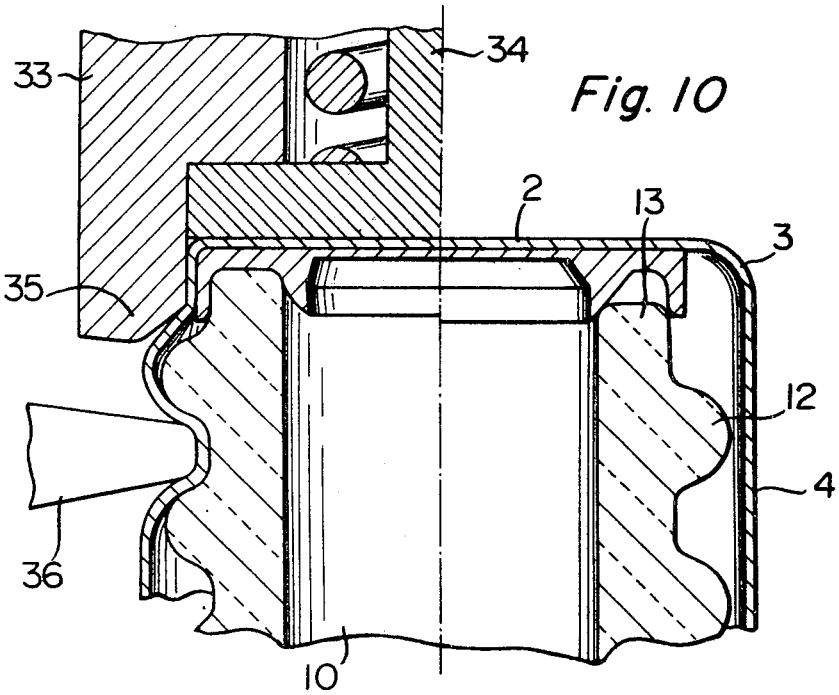
Fig. 10

CAP WITH SEALING LINER

BACKGROUND OF THE INVENTION

This invention relates to a cap, and a method for cap sealing. More specifically, the invention relates to a roll-on cap having a liner of a specified shape and a method for sealing a container using the cap.

In a conventional roll-on cap consisting of a metallic cap shell having a circular top and a skirt extending downwardly from the peripheral edge of the top and provided with a deformable shoulder and a thread-forming portion deformable along the thread of the opening part of a container, and a flexible liner provided inwardly of the top of the cap shell, the liner usually consists of a disc of paper or a synthetic resin such as polyvinyl chloride bonded to the top of the cap shell, or of a polyvinyl chloride plastisol flowed into the cap shell top.

The disc-shaped liner, however, has the defect that the cost of its production is high because of poor productivity, and the liner tends to drop off from the cap shell during transportation and sealing operations. On the other hand, the flow-in liner (spin liner) can be produced with high productivity. However, the polyvinyl chloride used as the material poses a problem of toxicity owing to the vinyl chloride monomer, and it is desired to avoid its use in caps for foodstuff containers.

Polyethylene has recently attracted attention as a liner material which can replace polyvinyl chloride. Unfortunately, polyethylene cannot be used to produce flow-in liners since it is difficult to convert to a plastisol and has poor adhesion to the cap shell.

SUMMARY OF THE INVENTION

The present inventor worked extensively on the method of using polyethylene as a liner material for roll-on caps, especially caps having high sealing properties. The work led to the discovery that when polyethylene is formed into a mold-punched liner of a specified shape, caps of especially superior performance can be obtained.

Thus, according to one aspect of the invention, there is provided a cap consisting of a metallic cap shell having a circular top and a skirt extending downwardly from the peripheral edge of the top and provided with a thread-forming portion deformable along the thread of the opening part of a container, and a flexible liner provided inside the top of the cap shell. The liner includes an annular protrusion having an inside diameter substantially equal to, or slightly larger than, the outside diameter of the sealing surface of the opening of a container to be sealed and having a perpendicular inside wall adapted to seal intimately against the peripheral sealing surface of the container opening and an upright outside wall spaced apart from the inner circumferential surface of the skirt.

BRIEF DESCRIPTION OF THE DRAWINGS

The cap of the invention will be described in detail below with reference to preferred embodiments shown in the accompanying drawings, in which:

FIGS. 9A and 9B are sectional views of molding punches that can be used to mold liners in the cap of this invention; and FIG. 10 is a sectional view showing the state of fitting the cap of this invention over the sealing surface of the opening of a container.

DETAILED DESCRIPTION OF THE INVENTION

Figure 1:
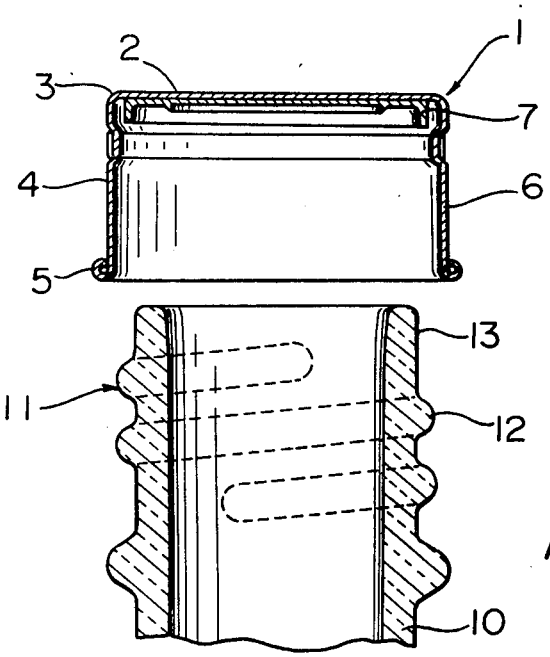
FIG. 1 is a sectional view of one embodiment of the cap in accordance with this invention.
Figure 2:
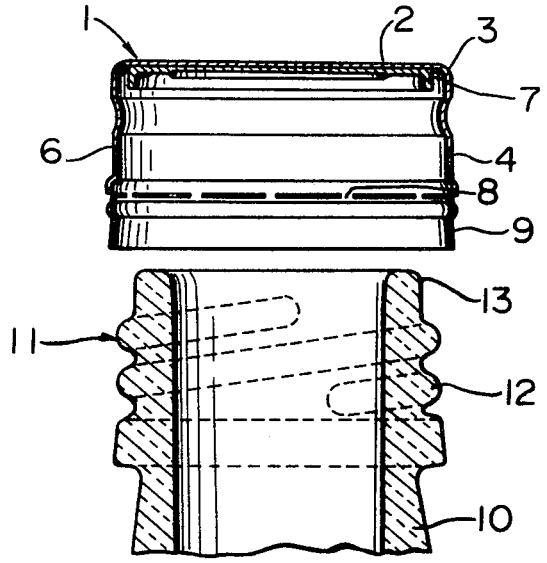
FIG. 2 is a sectional view of another embodiment of the cap of the present invention.

Basically, the cap of this invention includes two types. The first type is a "roll-on" cap consisting of (a) a metallic cap shell 1 having a circular top 2 and a skirt 6 extending downwardly from the peripheral edge of the top 2, skirt 6 being provided with a thread-forming portion 4 deformable along thread 12 of the opening portion 11 of a container such as a bottle 10 and a curled portion 5 at the bottom edge, and preferably further having a deformable shoulder 3, and (b) a flexible liner 7 provided inwardly of the top 2 of the cap shell 1, as shown in FIG. 1. The second type is a "roll-on pilferproof cap" consisting of (a) a metallic cap shell 1 having a circular top 2, a skirt 6 extending downward from the peripheral edge of the top 2 and provided with a thread-forming portion 4 deformable along thread 12 of the opening portion 11 of a container 10 to be sealed, and a band 9 integrally bonded to the lower end edge of the skirt 6 by a plurality of cuttable bridges 8, and preferably further having a deformable shoulder 3, and (b) a flexible liner 7 provided inwardly of the top 2 of the cap shell 1, as shown in FIG. 2.

Aluminum is by far the most suitable material for the cap shell 1. Other easily deformable materials, such as an ultrathin steel sheet, can also be used.

Figure 3:
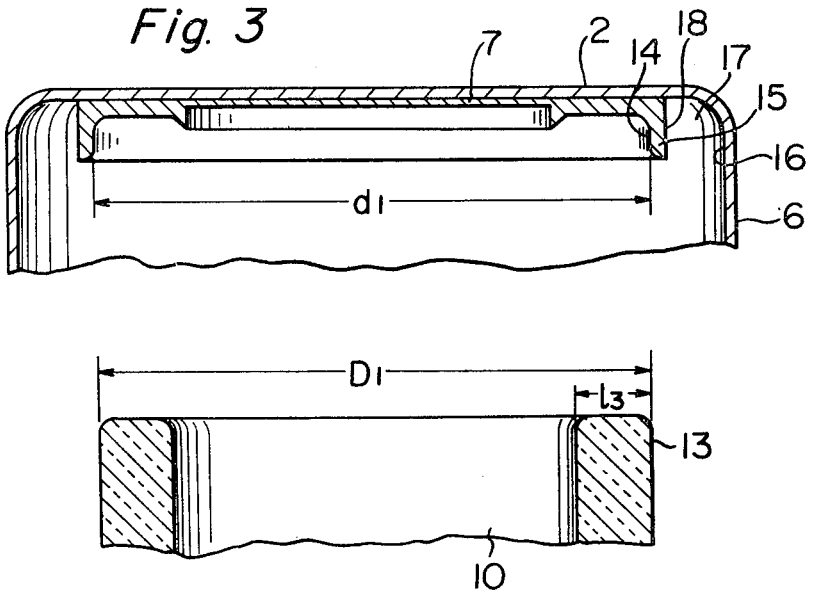
FIG. 3 is an enlarged sectional view of the top of the cap in accordance with the invention.

The important characteristic of the cap of this invention lies in the shape of the liner provided inwardly of the top of the cap shell. As shown in FIG. 3, the liner 7 used in the cap of this invention includes an annular protrusion 15 having an inside diameter ($d_1$) substantially equal to, or slightly larger than, the outside diameter ($D_1$) of the sealing surface 13 of the opening of a container 10 to be sealed. Protrusion 15 has a perpendicular inside wall 14 capable of sealing intimately to the outer periphery of the sealing surface 13 of the container opening and an outside wall 18 spaced apart from the inside circumferential surface 16 of the skirt 6 by a space 17.

Ideally, the inside diameter ($d_1$) of the annular protrusion 15 should be equal to the outside diameter ($D_1$) of the sealing surface 13 of the container opening. But in view of the errors that may occur at the time of molding the container or forming the liner, the suitable inside diameter ($d_1$) is as follows:

$$D_1' - \alpha_1 \leqq d_1\,(mm) \leqq D_1' + \alpha_1 + 0.7$$

wherein $D_1'$ is the standard target outside diameter in millimeters of the sealing surface of the container opening, and $\alpha_1$ is the maximum manufacturing tolerance in millimeters of $D_1'$.

The especially preferred range is shown by the following.

$$D_1' - \alpha_1 \leqq d_1 \leqq D_1' + \alpha_1$$

The standard or target outside diameter ($D_1'$) of the sealing surface of the container differs according to the type of the container. Usually, standard outside diameters of 20 to 70 mm are suitable for the caps of this invention. Accordingly to the common general knowledge of the bottle-making making industry, the maximum manufacturing tolerance ($\alpha_1$) of the outside diameter is within the range of 0.3 to 0.5 mm.

It is important that at least a part of the inside wall 14 of the annular protrusion 15 should be a perpendicular cylinder. Otherwise, there is no strict restriction on the sectional shape of the annular protrusion 15. It has been found by the inventor, however, that the sectional shape shown in FIG. 4 of the annular protrusion 15 is especially satisfactory for sealing performance.

Figure 4:
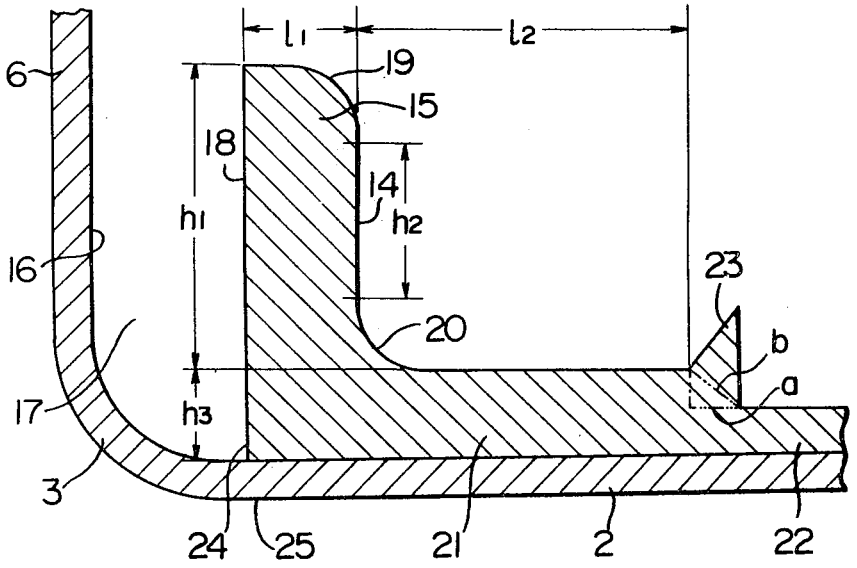
FIG. 4 is an enlarged sectional view of the annular protrusion and its vicinity to the liner in the cap of this invention.

In FIG. 4, the annular protrusion 15 is provided upright at substantially right angles to the top 2 of the cap shell, and it is desirable that the inside wall 14 and the outside wall 18 should be substantially perpendicular to the top 2. The distance between the inside wall 14 and the outside wall 18, that is, the thickness ($l_1$) of the annular protrusion 15, is not particularly restricted, and can be varied over a wide range according, for example, to the inside diameter ($d_1$) of the annular protrusion 15, the type of the cap shell, the material of the liner, the type of the container to be sealed, and the required sealing properties. Generally, the suitable distance is 0.3 mm $\leqq l_1 \leqq$ 1.5 mm, preferably 0.5 $mm \leqq l_1 \leqq$ 1.0 mm.

The height ($h_2$) of the perpendicular cylindrical part of the inside wall 14 is not critical, but advantageously, it is at least 0.3 mm. There is no strict limitation on the upper limit of $h_2$, but such upper limit may be not more than 1.0 mm. The preferred range of the height $h_2$ is 0.3 to 0.5 mm.

The height ($h_1$) of the outside wall 18 is not particularly important, and can be widely varied according, for example, to the type of the cap shell, the material of the liner, and the type of the container to be sealed. The height $h_1$ may be at least equal to $h_2$.

Figure 5:
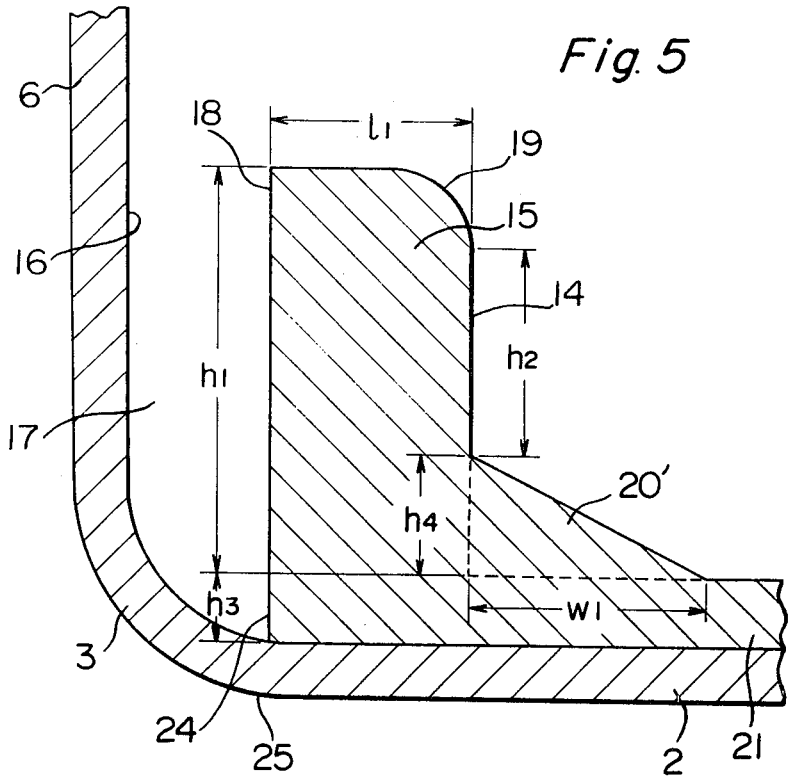
FIG. 5 is an enlarged sectional view of another embodiment of the annular protrusion and its vicinity to the liner of the cap of this invention.
Figure 7:
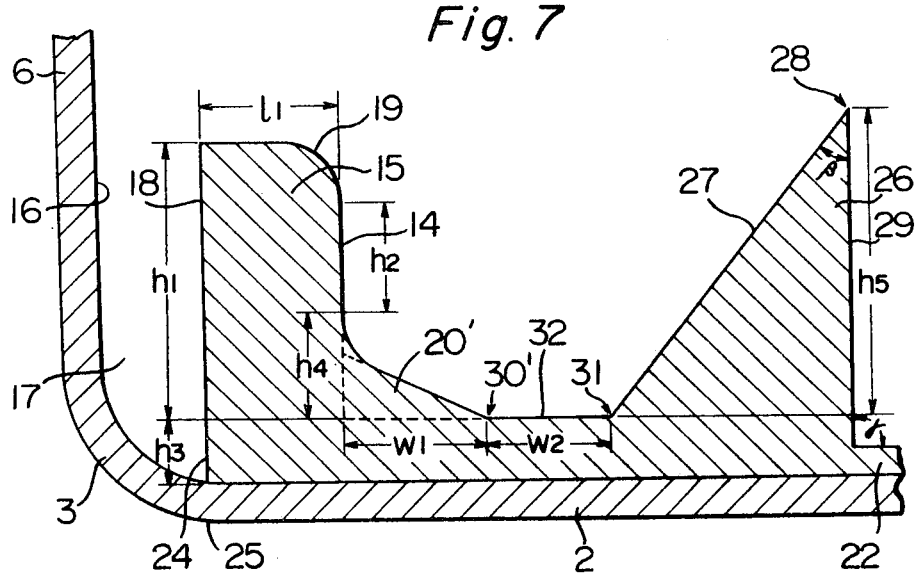
FIG. 7 is an enlarged sectional view of the annular protrusions of the liner in the cap of FIG. 6.

Desirably, the top portion 19 of the inside wall 14 is inclined toward the outside wall 18 for ease of engagement with the outside end of the sealing surface of the container opening. In particular, it may form a curved surface of a suitable diameter. Moreover, the base 20 of the inside wall 14 may form a curved surface of a suitable diameter as shown in FIG. 4 in order, for example, to increase sealing with the inside end of the sealing surface of a container to be sealed, to reinforce the annular protrusion 15, and to facilitate the molding of the liner. Alternatively, it may be desirable to provide a thick bottom portion 20' having a substantially triangular cross-section, as shown in FIG. 5 or 7. The width ($w_1$) of the bottom of the thick bottom portion 20' is not critical, but advantageously, it may be about 0.5 to 1.3 mm. Preferably, the height ($h_4$) of the portion 20' is 0.2 to 1.0 mm.

Thus, it is usual that the height ($h_1$) of the outside wall 18 is larger than the height ($h_2$) of the perpendicular cylindrical part of the inside wall 14. Usually, $h_1$ is 1.0 to 2.0 mm, preferably 1.3 to 1.7 mm, although it depends upon the size of the cap, and the material of the liner, for example.

The base 20 of the inside wall 14 of the annular protrusion 15 is connected to a thick portion 21 of the liner 7. The width ($l_2$) of the thick portion 21 can be made substantially equal to the thickness ($l_3$) of the sealing surface of the opening of a container to be sealed. The thickness ($h_3$) of the thick portion 21 can be sufficient to permit the absorption of the sealing pressure during the cap sealing operation. The thickness, however, is not critical, and can be varied according, for example, to the material of the liner. The thickness is usually 0.3 to 0.6 mm, and preferably about 0.4 to 0.5 mm.

The inward end edge of the thick portion 21 may have a steep shape as shown by dotted line *a* in FIG. 4 or a tapered shape shown by dotted line *b* in FIG. 4, and joins a thinner center panel portion 22 of the liner. In order to facilitate the formation of the liner, it is also possible to provide a projection 23 having a substantially triangular cross-sectional shape.

It is desirable on the other hand that the base portion 24 of the outside wall 18 of the annular projection 15, that is, the intersecting point between the annular protrusion and the top of the cap shell 1, should substantially register with the upper end edge 25 of the shoulder 3 of the cap shell 1, that is, the starting point of the curled portion at the peripheral edge of the top 2. In this way, a slight space 17, usually about 0.5 to 1.5 mm wide, is formed between the inner circumferential surface of the skirt 6 and the outside wall 18 of the annular protrusion.

As will be described hereinbelow, this space 17 is especially important when deforming the shoulder 3 of the cap shell 1 to achieve high sealing properties, and is effective for facilitating the deformation and preventing an abnormal deformation of the annular protrusion 15.

Thus, the present invention provides a cap having superior sealing properties.

It has been found that the sealing properties of the cap of the invention described above can be further increased if in addition to the annular protrusion 15 described hereinabove, the liner is provided with another annular protrusion, substantially triangular in cross section, which has an inside diameter substantially equal to, or slightly smaller than, the inside diameter of the sealing surface of the opening of a container to be sealed and includes an inclined outside wall capable of abutting against the inner circumferential edge of the sealing surface of the container opening.

In the following description, this additional annular protrusion will be referred to as "an inside annular protrusion", and the "annular protrusion 15" described hereinabove will be referred to as "an outside annular protrusion" in order to distinguish it from the inside annular protrusion.

Thus, according to another aspect of the invention, there is provided a cap consisting of a metallic cap shell having a circular top and a skirt extending downwardly from the peripheral edge of the top and provided with a thread-forming portion deformable along the thread of the opening part of a container, and a flexible liner provided inwardly of the top of the cap shell. The liner includes (1) an outside annular protrusion having an inside diameter substantially equal to, or slightly larger than, the outside diameter of the sealing surface of the opening of a container to be sealed and comprising a perpendicular inside wall adapted to seal intimately with the peripheral sealing surface of the container opening and an upright outside wall spaced apart from the inner circumferential surface of the skirt, and (2) an inside annular protrusion, substantially triangular in cross section, which has an inside diameter substantially equal to, or slightly smaller than, the inside diameter of the sealing surface of the container opening and includes an inclined outside wall capable of abutting against the inner circumferential edge of the sealing surface of the container opening.

The cap in this other aspect is described in greater detail by reference to accompanying FIGS 6 to 8.

Figure 6:
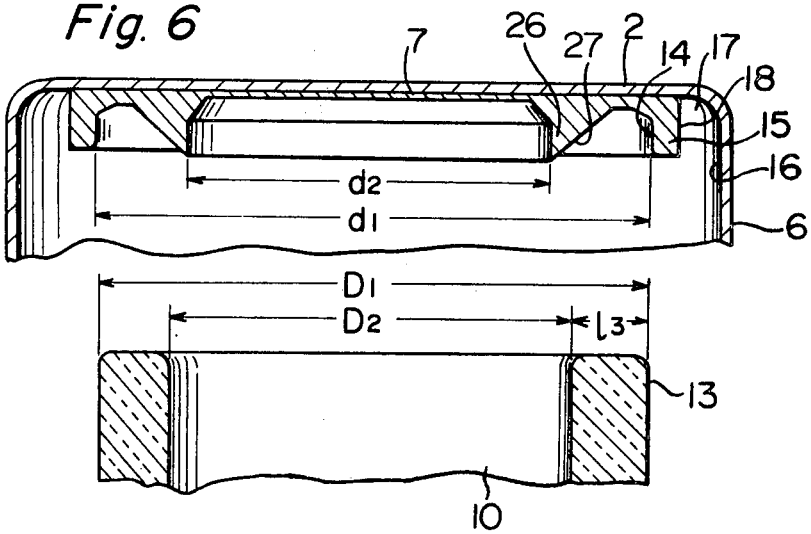
FIG. 6 is an enlarged sectional view of the top portion of the cap according to another embodiment of the invention.

Liner 7 used in the cap of this embodiment, as is shown in FIG. 6, includes (1) an outside annular protrusion 15 which has an inside diameter ($d_1$) substantially equal to, or slightly larger than, the outside diameter ($D_1$) of the sealing surface 13 of a container 10 to be sealed and includes (a) a perpendicular inside wall 14 capable of sealing intimately with the peripheral surface of the sealing surface 13, and (b) an upright outside wall 18 spaced apart from the inner circumferential surface 16 of the skirt 6 toward the center of the cap by a space 17, and (2) an inside annular protrusion 26 which has an inside diameter ($d_2$) substantially equal to, or slightly smaller than, the inside diameter ($D_2$) of the sealing surface 13 of the opening of container 10 and includes an inclined outside wall 27 capable of abutting against the inner circumferential edge of the upper rim of the sealing surface 13.

The structure of the outside annular protrusion 15 may be the same as that described hereinabove with regard to the "annular protrusion".

The inside annular protrusion 26 has a substantially triangular cross-section, and is composed of the outside wall 27 inclined divergingly outwardly from its apex 28, and an inside wall 29 which is substantially perpendicular.

The angle ($\beta$) of the apex 28 is not strictly limited, and can be varied according, for example, to the material of the liner. Generally, the suitable angle is 30° to 50°, above all about 45°. The inside wall 29 is desirably perpendicular, but can have some degree of inclination. For example, the angle ($\gamma$) between the inside wall 29 and the center panel 22 of the liner may be $90° < \gamma \leqq 100°$.

Figure 8:
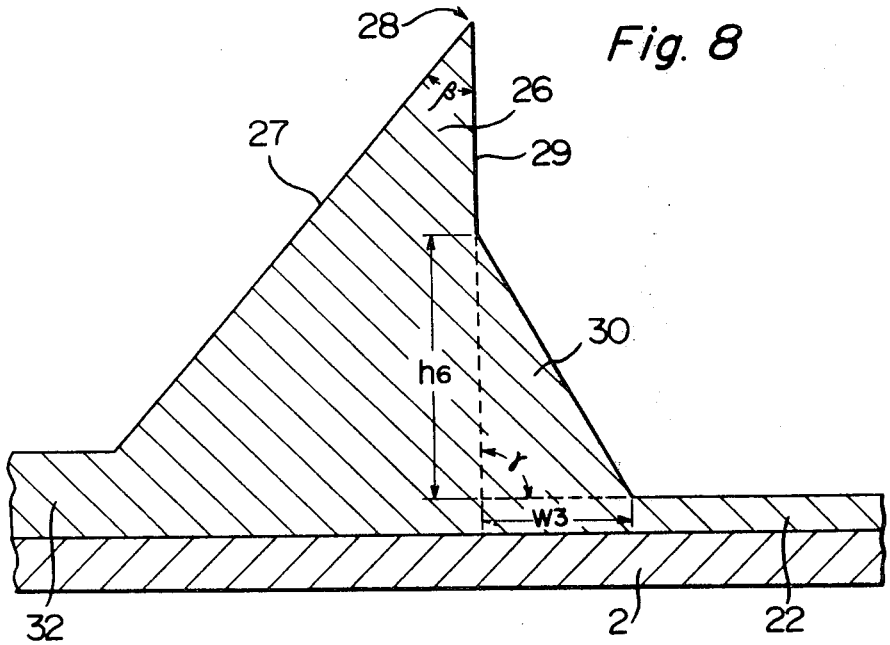
FIG. 8 is a sectional view of another embodiment of the inside annular protrusion.

At the bottom of the inside wall surface, a thick bottom part 30, triangular in cross section, may be provided as shown in FIG. 8 from the standpoint of, say, reinforcement and liner moldability. The width ($w_3$) and height ($h_6$) of the thick bottom part 30 are not critical, and can be varied according to the height of the inside annular protrusion 26. Generally, the width ($w_3$) is 0.4 to 0.7 mm, and the height ($h_6$) is about ⅝ to one times the height ($h_5$) of the inside annular protrusion 26, specifically about 0.8 to 1.2 mm.

The inside diameter ($d_2$) of the inside annular protrusion 26, that is, the diameter of the inside annular protrusion 26 with the position of the apex 28 in FIG. 7 as a standard, is made substantially equal to, or slightly smaller, than the inside diameter ($D_2$) of the sealing surface 13 of the opening of a container, for example, a bottle, to be sealed so that the outside wall 27 of the inside annular protrusion 26 abuts the inner circumferential edge of the sealing surface 13. Thus, it is desirable that the inside diameter ($d_2$) of the inside annular protrusion 26 is within the following range with regard to the inside diameter ($D_2$) of the sealing surface 13.

$$D_2' - \alpha_2 - 0.6 \leqq d_2\,(mm) \leqq D_2' - \alpha_2$$

wherein $D_2'$ is the standard or target inside diameter (mm) of the sealing surface of the container, and $\alpha_2$ is the maximum manufacturing tolerance (mm) of $D_2'$. The especially preferred range of the inside diameter $d_2$ is expressed by: $D_2' - \alpha_2 - 0.3 \leqq d_2 \leqq D_2' - \alpha_2$ The standard inside diameter ($D_2'$) of the sealing surface differs according to the type of the container, but usually inside diameters of 17 to 67 mm are suitable for the cap of the present invention. The maximum manufacturing tolerance ($\alpha_2$) of the inside diameter is 0.4 to 0.6 mm according to the common general knowledge of the bottle-making industry.

The height ($h_5$) of the inside annular protrusion 26 may be substantially equal to the height ($h_1$) of the outside annular protrusion 15. For example, the height ($h_5$) is within the following range.

$$h_1\,(mm) - 0.3\ mm \leqq h_5\,(mm) \leqq h_1\,(mm) + 0.5\ \text{mm}$$

The height ($h_5$) is somewhat larger than the height ($h_1$), and preferably within the following range:

$$h_1\,(mm) \leqq h_5\,(mm) \leqq h_1\,(mm) + 0.2\ \text{mm}$$

The lower bottom edge 30' of the inside wall 14 of the outside annular protrusion 15 may be connected directly to the lower bottom edge 31 of the outside wall of the inside annular protrusion 26. Preferably, as shown in FIG. 7, they are connected to each other through a thick portion 32 which makes contact with the top face of the sealing surface of the container. The width ($w_2$) of the thick portion 32 can be one-fourth to two-fifth of the thickness ($l_3$) of the sealing surface 13 of the container to be sealed. The thickness ($h_3$) of the thick portion 32, as described hereinabove with regard to the thick portion 21 in FIG. 4, may be sufficient to absorb the sealing pressure at the time of the cap sealing operation. This thickness is not critical, and can be varied according to the material of the liner. Usually, it is 0.4 to 0.8 mm, preferably about 0.5 to 0.7 mm.

The liner having the specified shape in accordance with the present invention can be provided in a cap shell by any method known per se, for example, by the apparatus and methods frequently utilized in providing molded liners on the inner surface of a crown cap shell which are described, for example, in British Patent No. 1,112,023, Japanese Patent Publication No. 19386/73, Japanese Laid-Open Patent Publication No. 105689/74, and U.S. Pat. Nos. 2,954,585, 3,135,019, and 3,212,131. Advantageously, molding punches of the types shown in FIGS. 9A and 9B can be used.

Polyethylene is most preferred as a material for the liner, but other polyolefin resins such as polypropylene, rubbers, and polyvinyl chloride can also be used. The polyethylene suitably has a melt index of 0.5 to 8.0, especially 2.0 to 6.0.

Where a polyolefin such as polyethylene is used as a material for the liner, it is desirable to provide an oxidized polyethylene-containing lacquer layer on that surfade of the cap shell to which the liner is to be applied. This serves to improve the adhesion of the liner material to the surface of the cap shell. The details of the usable oxidized polyethylene-containing lacquer are disclosed in German Laid-Open Patent Specifications (DOS) Nos. 2,504,623 and 2,617,526.

The cap provided by the present invention can be used widely for sealing various containers, especially a bottle. It can be used as an ordinary roll-on cap, and is especially useful for sealing containers which require a high level of sealing properties (both under high and reduced pressures). In particular, the cap of this invention is useful for sealing by means of roll-on sealing machines adapted to deform the annular shoulder of the cap to enhance sealing properties, such as those described in U.S. Pat. Nos. 3,039,247 and 3,303,955 and British Pat. No. 957,739.

For example, as shown in FIG. 10 which illustrate container sealing by the cap shown in FIGS. 6 to 8, the cap of this invention is fitted over the sealing surface 13 of a container 10 having a thread 12 at its outside. While pressing the top 2 of the cap by a lifter 34 of a pressure block 33, the shoulder 3 of the cap is deformed toward the sealing surface 13 of the container by means of a pressure block sleeve 35 to thereby reduce the diameter of the shoulder 3. At the same time, the thread-forming portion 4 of the cap is deformed along the thread 12 of the container by means of a thread roller. This procedure results in capping having a high level of sealing properties.

The specific operating method for the roll-on sealing machine is well known to those skilled in the art, and its detailed description is omitted in this application.

The cap of this invention brings about various industrial advantages. For example, because of the special shape of the liner described above, the liner does not undergo severe conditions at the time of sealing, but adheres completely to the sealing surface of the container to achieve a high degree of sealing performance. Furthermore, a resin of a relatively high hardness can be used as a material for the liner, and the amount of the resin used can be about two-third of that used previously in the same type of caps.

Furthermore, unlike the production of conventional flow-in caps, the present invention can always afford caps having a certain liner profile, and the occurrence of sealing defects, such as "oblique capping", "top cracking,", "poor drawing", or "bridge break", can be prevented almost completely. Another advantage is that the deformation of the cap shoulder can be easily performed since there is a space between the annular protrusion of the liner and the peripheral wall of the cap. In addition to the excellent sealing properties of the caps of this invention, it also has the advantage that the cap has strong resistance to various kinds of impact such as falling impact, thermal shock, or vibration.

The following Examples further illustrate the present invention.

EXAMPLE 1

One surface of an aluminum sheet having a thickness of 0.24 mm was imprinted and coated with a vinyl-type protective lacquer, and the other surface was coated with an epoxy paint containing oxidized polyethylene (a product of Allied Chemical Corporation: average molecular weight 6500, acid value 28.0, oxygen content 4.36% by weight). The aluminum sheet was then punched by a press to form 28 mm caps so that the surface coated with the epoxy paint became the inside surface. The caps were knarled and perforated, and by using a cap-lining machine, 240 mg of high pressure polyethylene (density 0.92; melt index 4.5) molten at 170° C. was placed in the cap shells pre-heated to 110° C. By a molding punch of the type shown in FIG. 9A, it was molded into the shape shown in FIG. 3.

The resulting polyethylene liner had a shape of the following specifications.

| | |
|---|---|
| Inside diameter ($d_1$) of the annular protrusion: | 24.4 mm |
| Thickness ($l_1$) of the annular protrusion: | 0.5 mm |
| Height ($h_2$) of the perpendicular cylindrical part of the inside wall of the annular protrusion: | 0.3 mm |
| Height ($h_1$) of the outside wall of the annular protrusion: | 1.5 mm |
| R (radius of curvature) of the top of the inside wall: | 0.4 mm |
| R of the bottom base of the inside wall: | 0.8 mm |
| Width ($l_2$) of the thick portion: | 2.65 mm |
| Thickness ($h_3$) of the thick portion: | 0.4 mm |
| Thickness of the center panel: | 0.16 mm |

The sealing properties of the caps so obtained were tested by the following methods, and the results are shown in Table 1.

(1) Continued pressure retention test (a) 65° C. heat-treatment method (according to JIS S-9017)

A prescribed bottle (with a caliber of 24.1 mm) was sealed with the sample cap in the manner illustrated in FIG. 10. The pressure of the inside of the bottle after capping was adjusted to 4 volumes by sulfuric acid and sodium hydrogen carbonate. The bottle was allowed to stand at room temperature for several hours to stabilize the inside pressure. Then, the bottle was dipped in a constant temperature tank maintained at 65° C., and heated for 1 hour. During this time, the bottle was observed for gas leakage. One hour later, the bottle was taken out from the tank, and the liquid inside the bottle was cooled to 25° C. The inside pressure at this time was measured by a pressure gauge, and evaluated.

(b) 70° C. heat-treatment method

The test procedure in (a) was repeated except that the heat-treatment temperature was changed to 70° C.

(2) Observation of the sealed condition

After capping, the state of oblique capping, top cracking, poor drawing, and bridge break was visually observed, and the number of each of such defects that occurred was counted.

Table 1

| Test items | | Cap of the invention | | Polyvinyl chloride flow-in cap (comparison) | |
|---|---|---|---|---|---|
| | Inside pressure (VOL) | 65° C. | 70° C. | 65° C. | 70° C. |
| Continued pressure retention test | 4.0 | 92 | 81 | 88 | 78 |
| | 3.9 | 6 | 18 | 11 | 20 |
| | 3.8 | 2 | 1 | 1 | 1 |
| | . | . | . | . | . |
| | . | . | . | . | . |
| | . | . | . | . | . |
| | 3.4 | 0 | 0 | 0 | 1 |
| | Average (VOL) | 3.99 | 3.98 | 3.98 | 3.97 |

Table 1-continued

| | Test items | Cap of the invention | Polyvinyl chloride flow-in cap (comparison) |
|---|---|---|---|
| | Oblique capping | 0 | 0 |
| Sealed condition | Top cracking | 0 | 0 |
| | Poor drawing | 0 | 0 |
| | Bridge break | 0 | 8 |

Note: The numerals refer to the number per 100 caps.

EXAMPLE 2

One surface of an aluminum sheet, 0.24 mm thick, was imprinted and coated with a vinyl-type protective lacquer, and the other surface was coated with an epoxy paint containing oxidized polyethylene (a product of Allied Chemical Corporation; average molecular weight 6500, acid value 28.0, oxygen content 4.36 wt.%). The aluminum sheet was then punched by a press to form 28 mm caps so that the surface coated with the epoxy paint became the inside surface. The caps were knarled and perforated, and by using a cap-lining machine, 240 mg of high pressure polyethylene (density 0.92; melt index 4.5) molten at 170° C. was placed in the cap shells pre-heated to 110° C. By a molding punch of the type shown in FIG. 9B, it was molded into the shape shown in FIG. 7.

The polyethylene liner so formed had a shape of the following specifications.

| | |
|---|---|
| Inside diameter ($d_1$) of the outside annular protrusion: | 24.2 mm |
| Thickness ($l_1$) of the outside annular protrusion: | 0.9 mm |
| Height of the thick bottom portion of the outside annular protrusion: | 0.4 mm |
| Height ($h_2$) of the perpendicular cylindrical part of the inside wall of the outside annular protrusion: | 0.4 mm |
| Height ($h_1$) of the outside wall of the outside annular protrusion: | 1.4 mm |
| R (radius of curvature) of the top of the inside wall of the outside annular protrusion: | 0.2 mm |
| Width ($w_1$) of the bottom surface of the thick bottom portion of the outside annular protrusion: | 0.9 mm |
| Thickness ($h_3$) of the thick portion: | 0.6 mm |
| Width ($w_2$) of the thick portion: | 0.6 mm |
| Inside diameter ($d_2$) of the inside annular protrusion: | 18.0 mm |

-continued

| | |
|---|---|
| Height ($h_5$) of the inside annular protrusion: | 1.55 mm |
| Angle ($\beta$) of the apex of the inside annular protrusion: | 45° |
| Thickness of the center panel portion: | 0.10 mm |

The caps obtained were tested for sealing properties in the same way as in Example 1, and the results are shown in Table 2.

Table 2

| Test items | | Cap of the invention | | Polyvinyl chloride flow-in cap (comparison) | |
|---|---|---|---|---|---|
| | Inside pressure (VOL) | 65° C. | 70° C. | 65° C. | 70° C. |
| Continued pressure retention test | 4.0 | 95 | 83 | 88 | 72 |
| | 3.9 | 3 | 14 | 9 | 23 |
| | 3.8 | 2 | 3 | 3 | 5 |
| | . | . | . | . | . |
| | . | . | . | . | . |
| | . | . | . | . | . |
| | 3.4 | 0 | 0 | 0 | 1 |
| | Average (VOL) | 3.99 | 3.97 | 3.98 | 3.91 |
| Sealed condition | Oblique capping | 0 | | 0 | |
| | Top cracking | 0 | | 0 | |
| | Poor drawing | 0 | | 4 | |
| | Bridge break | 0 | | 6 | |

Note: The numerals refer to the number per 100 caps.

The caps manufactured in Example 2 were evaluated also by the following tests.

(A) Falling test

Fifty sample bottles which had been capped and whose inside pressure had been adjusted to 4 volumes in the same way as in Example 1 were packed in a carton, and let fall five times onto a concrete floor from a height of 30 cm. Then, the samples were examined for gas leakage. It was found that none of the sample bottles permitted gas leakage.

(B) Thermal shock test

Sample bottles which had been capped and whose inside pressure had been adjusted to 4 volumes in the same way as in Example 1 were allowed to stand for 30 minutes at 5° C., and then at 50° C. for 30 minutes. This procedure was repeated twice, and the samples were examined for gas leakage. It was found that none of the sample bottles permitted gas leakage.

(C) Vibration test

Fifty sample bottles which had been capped and whose inside pressure had been adjusted to 4 volumes in the same way as in Example 1 were packed in a carton, and while maintaining the bottles upright, subjected to oscillation for 30 minutes with an amplitude of 3 mm at a rate of 1,080 times per minute. Then, the bottles were examined for gas leakage. It was found that none of the sample bottles permitted gas leakage.

What we claim is:

1. A cap for use in sealing a container of the type including an opening portion having therein an opening surrounded by a sealing surface including an upper rim and inner and outer peripheral surfaces, with an exterior thread provided below the sealing surface, said cap comprising:

a metallic cap shell having a circular top and a skirt extending downwardly from the peripheral edge of said top, said skirt having a thread forming portion which is deformable along the exterior thread of a container on which the cap is to be used; and a flexible liner provided inwardly of said top of said cap shell, said liner comprising:

an outer annular protrusion extending downwardly from said top, said outer annular protrusion having an inner diameter substantially equal to, or slightly larger than, the outer diameter of the sealing surface of the container on which the cap is to be used, said outer annular protrusion having a radially inner wall extending substantially perpendicular to said top, said inner wall of said outer annular protrusion forming means for intimately sealing against the outer peripheral surface of the container on which the cap is to be used, said outer annular protrusion having an upright radially outer wall which is spaced radially inwardly from the inner circumferential surface of said skirt; and an inner annular protrusion extending downwardly from said top at a position radially inwardly of said outer annular protrusion, said inner annular protrusion having a substantially triangular cross-sectional configuration, said inner annular protrusion having an inner diameter substantially equal to, or slightly smaller than, the inner diameter of the sealing surface of the container on which the cap is to be used, said inner annular protrusion including inner and outer walls which converge downwardly at an apex angle of 30° to 50°, said outer wall being inclined upwardly and radially outwardly and forming means for abutting against the inner circumferential edge of the upper rim of the sealing surface of the container on which the cap is to be used.

2. A cap as claimed in claim 1, wherein said cap shell has a deformable shoulder.

3. A cap as claimed in claim 1, wherein said liner is made of polyethylene.

4. A cap as claimed in claim 1, wherein said inner diameter ($d_1$) of said outer annular protrusion is within the range shown by the expression:

$$D_1' - \alpha_1 \leqq d_1\,(mm) \leqq D_1' + \alpha_1 + 0.7$$

wherein $D_1'$ is the standard target outer diameter (mm) of the sealing surface of the container on which the cap is to be used, and $\alpha_1$ is the maximum manufacturing tolerance (mm) of $D_1'$.

5. A cap as claimed in claim 1, wherein said inner diameter ($d_1$) of said outer annular protrusion is within the range shown by the expression:

$$D_1' - \alpha_1 \leqq d_1 \leqq D_1' + \alpha_1$$

wherein $D_1'$ is the standard target outer diameter (mm) of the sealing surface of the container on which the cap is to be used, and $\alpha_1$ is the maximum manufacturing tolerance (mm) of $D_1'$.

6. A cap as claimed in claim 1, wherein said apex angle is approximately 45°.

7. A cap as claimed in claim 1, wherein said inner diameter ($d_2$) of said inner annular protrusion is within the range shown by the expression:

$$D_2' - \alpha_2 - 0.6 \leqq d_2\,(\mathrm{mm}) \leqq D_2' - \alpha_2$$

wherein $D_2'$ is the standard target outer diameter (*mm*) of the sealing surface of the container on which the cap is to be used, and $\alpha_2$ is the maximum manufacturing tolerance (*mm*) of $D_2'$.

8. A cap as claimed in claim 1, wherein said inner diameter ($d_2$) of said inner annular protrusion is within the range shown by the expression:

$$D_2' - \alpha_2 - 0.3 \leqq d_2 \leqq D_2' - \alpha_2$$

wherein $D_2'$ is the standard target outer diameter (mm) of the sealing surface of the container on which the cap is to be used, and $\alpha_2$ is the maximum manufacturing tolerance (mm) of $D_2'$.

9. A cap as claimed in claim 1, wherein said outer and inner annular protrusions have substantially the same heights.

* * * * *